United States Patent [19]

Wilson

[11] 4,429,727

[45] Feb. 7, 1984

[54] LOG SPLITTER

[76] Inventor: Robert C. Wilson, 1105 N. Stephenson Hwy., Apt. 74, Royal Oak, Mich. 48067

[21] Appl. No.: 370,365

[22] Filed: Apr. 21, 1982

[51] Int. Cl.[3] ..... B27L 7/00

[52] U.S. Cl. ..... 144/193 C; 144/193 R; 144/366

[58] Field of Search ..... 144/193 R, 193 C, 193 D; 254/104

[56] References Cited

U.S. PATENT DOCUMENTS

| | | | |
|---|---|---|---|
| 1,195,423 | 8/1916 | Waters | 254/104 |
| 1,380,559 | 6/1921 | Jespersen | 254/104 |
| 3,377,052 | 4/1968 | Hagen | 254/104 |
| 4,254,808 | 3/1981 | Nokes | 144/193 C |
| 4,280,540 | 7/1981 | Meacham | 144/193 C |

*Primary Examiner*—W. D. Bray

*Attorney, Agent, or Firm*—Cullen, Sloman, Cantor, Grauer, Scott & Rutherford

[57] ABSTRACT

A log splitter is formed of a vertically arranged tube, within which a metal rod is telescopically slidably fitted. The lower end of the rod is formed as a hammer block. A pointed, wedge-like tip is secured upon the lower end of the tube and has an anvil block portion that extends upwardly into the tube. Transversely extending hand grips are provided upon the upper end of the rod for manually raising and lowering the rod to impact the hammer block against the anvil block for driving the tip into a log section. A guide maintains the axial alignment of the rod within the tube and limits the travel of the rod outwardly of the tube.

1 Claim, 6 Drawing Figures

LOG SPLITTER

BACKGROUND OF INVENTION

Log sections are commonly split into firewood size pieces by means of either an ax or a wedge driven by a sledge hammer. Considerable force and accuracy of swing are required when using either a long-handled ax or a sledge for this purpose. Particularly, where an ax is used, it is necessary to swing the ax head into approximately the same place in the wood section on each swing, in order to begin a split and to continue it through the section. Since this is difficult to do, ax splitting is relatively time-consuming for the results achieved.

Further, the swinging of an ax or a sledge hammer is dangerous due to the possibility of breaking a handle or of the head flying off the handle or of the head striking someone in the near vicinity of the operator. Moreover, both ax and wedge splitting ordinarily require considerable bending and stooping of the operator to properly align the log after blows that cause the log to either tip or turn over or, where necessary, to reposition the wedge as it penetrates into the log.

Thus, it is desirable to provide a log splitting system which utilizes a hammer action to drive a wedge-like point into a log for splitting it, but with minimal physical movement and with maximum accuracy to reduce the number of blows required. This invention relates to such a device for splitting log sections into firewood fire pieces as a replacement for a coventional ax or wedge and hammer.

SUMMARY OF INVENTION

The invention herein contemplates a log splitting device formed of a vertically arranged tube within which is telescoped a heavy rod whose lower end forms a hammer block and whose upper end is provided with a handle grip so that it may be lifted and lowered within the upright tube. The lower end of the tube is provided with a wedge-shaped tip having an anvil-like block portion extending upwardly within the tube. The lower, hammer block portion of the rod impacts against the anvil block when the weighted rod is either dropped or manually lowered rapidly. Thus, the force of repeated impacts due to raising and lowering the weighted rod, drives the wedge tip into the wood until the log is completely split.

The invention further contemplates the provision of a secondary handle or grip secured to the upper end of the tube so that the operator may simultaneously grip the rod handle and the tube handle to thereby lock the rod relative to the tube so that the device may be moved about and positioned while the rod is fully telescoped within the tube.

One object of the splitter herein is to provide a tool which can be easily manipulated by a standard operator who does not have to swing his arms, as in the case of operating an ax or sledge, but rather may move his arms upwardly and downwardly. Thus, by reducing the nature and the direction of movement of the operator's arms, the usual hazards of swinging an ax or a hammer are eliminated and likewise, the bending and stooping movements, which typically accompany wood splitting, are virtually eliminated.

A further object of the invention is to provide a system wherein a wedge an be driven into a wood section without the wedge either twisting or tipping relative to its direction of movement, as usually happens in the case of a hammer and wedge type of splitting, so that repeated blows upon the wedge tip can be accurately applied and the splitting action of the tip is along a single direction.

Another object of this invention is to provide a simple, relatively inexpensive log splitting device which can be made with considerable inaccuracy of parts, including substantial tolerances of the fits between the parts, and which can utilize without machining, conventional bar stock and rod stock, so that the expense of manufacture is considerably reduced. Moreover, the substantial inaccuracy of fits which are tolerated in the construction, materially reduces the affect of rusting or damage due to use. That is, the device may be subjected to adverse weather conditions for a long period of time and may be improperly handled or mishandled, without any substantial adverse affect in almost all cases. Consequently, the device has an unusual durability and tolerance for mishandling or improper storage or maintenance.

Still a further object of this invention is to provide a telescopically slidable weighted rod within an elongated tube, which rod may be lifted and then gravity dropped to impact against an anvil portion of a wedge which is shaped to first penetrate and then widen the split formed by the penetration in a block of wood. The rod may be immovably fixed within the tube by simple manual grasping of the handles secured to each so that the assembly can be easily transported or positioned or otherwise manipulated.

These and other objects and advantages of this invention will become apparent upon reading the following description, of which the attached drawings form a part.

DETAILED DESCRIPTION

Figure 1:
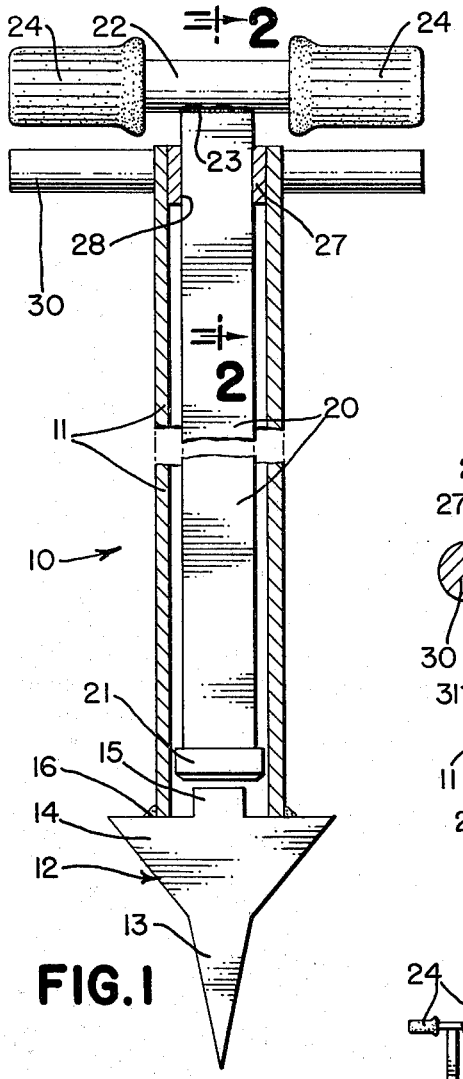
FIG. 1 is a cross-sectional, elevational view of the log splitter.

The log splitter 10 comprises an elongated, square cross-section tube 11. A wedge tip member 12 is secured to the lower end of the tube 11. The tip member is roughly arrow-head shaped with a lower, elongated, narrow and sharp pointed V-shaped point portion 13. Above the point portion the tip is formed as a wider V-shaped portion 14.

The upper, central part of the tip member is extended to form an anvil block portion 15 which fits within the lower end of the tube 11. This anvil block portion is aligned with the central axis of the tip.

The tip member is welded at 16 to the lower end of the square tube so that the tube and tip form a single unit.

Telescopically and slidably arranged within the tube is an elongated rod 20. The rod is preferably formed of a square cross-section steel bar. The lower end of the rod is provided with an enlarged hammer block portion 21 which may be made of a separate piece of square shaped bar stock which is cut to size and then welded to the lower end of the rod at 21*a*.

A handle 22, formed of a steel shaft or rod-like bar, is welded at 23 to the upper end of the rod 20. Preferably, bicycle type handle bar grips 24 are slipped over the opposite ends of the handle which may then be grasped by both hands of the user. Such grips are typically formed of a rubber-like plastic material molded into a hand grip shape.

The rod extends through a bushing 27 which has a square shaped opening 28 to slidably receive the rod. This bushing is secured, as by welding, within the upper end of the tube 11. Thus, it functions as a guide for the rod and also has a stop. That is, when the rod is raised upwardly to the maximum extent, the hammer block 21 contacts the bottom of the bushing 27 and is stopped against removal of the rod upwardly from the tube.

Figure 2:
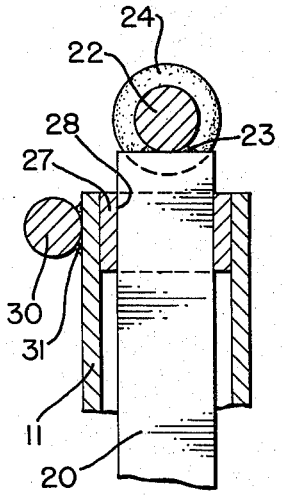
FIG. 2 is an enlarged, fragmentary, cross-sectional view taken in the direction of arrows 2—2 of FIG. 1.
Figure 3:
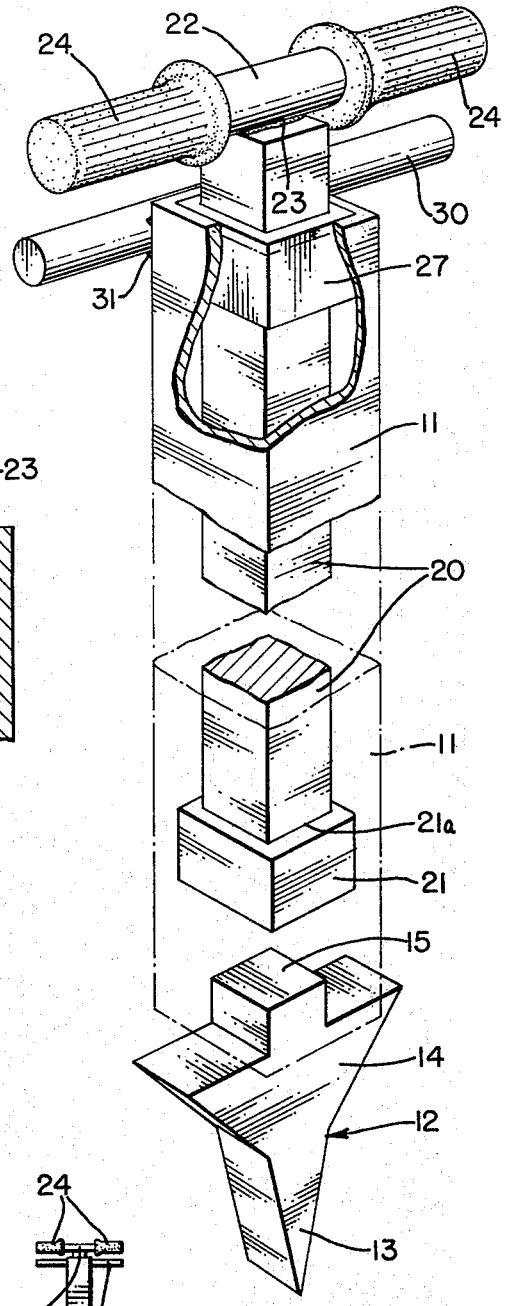
FIG. 3 is an enlarged, perspective, partially cut-away view of the log splitter.

A secondary handle 30, formed of a rod is welded at 31 to the tube (see FIG. 2). This secondary handle is closely adjacent to the primary handle 22 when the rod is completely telescoped within the tube. Thus, the user can grasp both handles simultaneously when desired.

Figure 4:
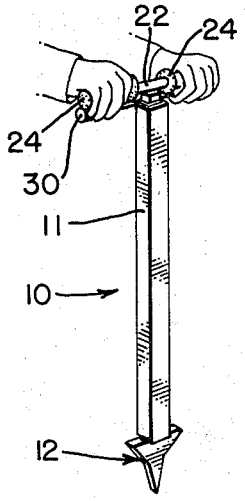
FIG. 4 is a perspective, schematic view showing the log splitter being carried for positioning upon a log section.

In operation, the splitter is first carried and positioned upon a log. The user may grasp the opposite ends of the primary and secondary handles, as illustrated in FIG. 4, to keep the rod and tube together for manipulating and positioning the device.

Figure 5:
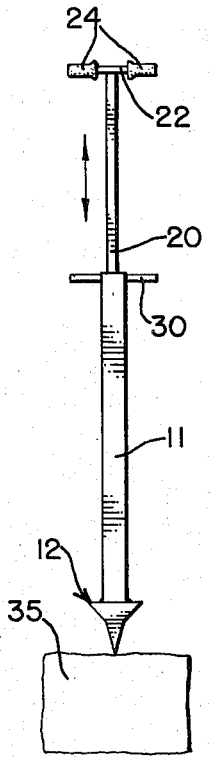
FIG. 5 is an elevational view showing the log splitter positioned upon a log, with the rod extended above the tube.
Figure 6:
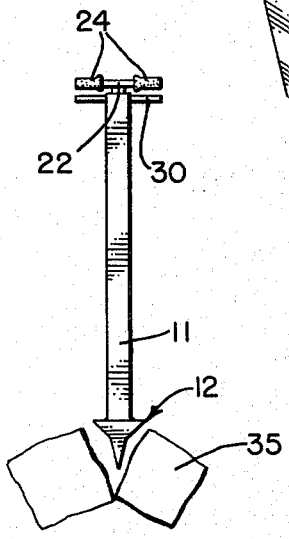
FIG. 6 is a view similar to FIG. 5, but showing the rod dropped for impacting against the wedge tip member and splitting the log.

Once the splitter is arranged upon a log, the user releases the secondary handle 30 and lifts the rod upwardly by grasping and raising the handle 22, as shown in FIG. 5. Then, the user may either release his lifting force to let the rod drop due to the force of gravity or usually, let the rod drop with a downward assisting force applied to the handle.

When the rod drops downwardly, either by gravity or with a combination of gravity and the user's force, the hammer block 21 on the bottom of the rod strikes or impacts against the anvil block portion 15 of the wedge shaped tip member. The force of the impact drives the wedge into the wood, with the pointed tip of the wedge penetrating the wood and the split widened by the upper widened portion 14 of the tip member. Depending upon the size and condition of the wood log, one or more blows may be required to split the log.

After the log is split, the user resumes his grasp upon the secondary handle 30 so that he can then move the splitter device away from the log with the rod fully retracted within the tube.

The sizes and shapes of the parts may be varied considerably. By way of an example of a satisfactory size, the tube 11 may be formed of steel tubing which is approximately 2"×2" in size with a 1/16" thick wall and about 24" long. The rod is formed of a smaller cross-sectional shape, such as $1\frac{1}{2}''\times1\frac{1}{2}''$. If the rod is made of steel bar stock, no machining is necessary since the tolerances are so great. Thus, except for relatively loose fit between the bushing opening and the bar forming the rod, very little machining is required to produce this log splitter.

The rod has considerable weight. Thus, when it is dropped down, the substantial force is transmitted through the hammer block and anvil block portions of the rod and wedge tip members, respectively, and directly through the pointed tip and into the log. Thus, the weight of the rod, along with any manual effort, is unidirectionally transmitted into the log each time the rod is raised and lowered. Consequently, because the force is concentrated and applied to the same place each time, the log is effectively split with a minimal number of blows.

Having fully described an operative embodiment of this invention, I now claim:

1. A log splitter comprising:

a vertically arranged, elongated, generally square cross-section tube and a similarly cross-sectional shaped rod fitted within and telescopically slidably arranged within the tube and extending out of the upper end of the tube;

first handle means formed on the upper end of the rod for manually supporting and handling the log splitter including an elongated rod-like member secured at its center to the upper end of the rod with hand grips formed on opposite sides of the rod axis;

an enlarged hammer block portion formed upon the lower end portion of the rod;

a pointed wedge tip member secured upon the lower end of the tube and having an anvil block portion arranged within the lower end of the tube and extending a short distance upwardly within the tube for receiving axially downwardly directed impacts from said hammer block portion;

said rod slidably extending through a guide and stop bushing secured within the upper end of the tube, with the bushing being coaxially arranged relative to the axes of the tube and rod and having a cross-sectionally shaped opening corresponding to the cross-sectional shape of the rod, and with said bushing preventing rotation of the rod within the tube and forming a stop for limiting the upward movement of the rod when the bushing is contacted by the hammer block portion;

secondary handle means secured upon the upper end of the tube closely adjacent to said elongated member of said first handle means when the rod is maximally retracted within the tube for permitting simultaneous manual gripping of the hand grips and secondary handle means for temporarily securing the rod and tube together against relative telescopic movement, and said secondary handle means comprising an elongated shaft arranged below and parallel to said hand grips so that the shaft and adjacent hand grips may be manually grasped together for manually locking the rod relative to the tube; and said wedge tip member being formed in two integral sections, namely, a lower, narrow, elongated, sharp pointed section and an upper, wide, roughly V-shaped section whose edges diverge at a relatively wide angle as compared with the divergence of the edges of the lower section with which the upper section is integral, for first penetrating into a log and then widening the split formed in the log;

whereby the tip member on the lower end of the tube pierces and splits a log section when the tip is rested upon the log section and the rod is manually raised and then rapidly lowered so that the hammer block portion impacts the anvil block portion.

* * * * *